United States Patent [19]

Kakino

[11] Patent Number: 4,618,801

[45] Date of Patent: Oct. 21, 1986

[54] FLAT CATHODE RAY TUBE

[75] Inventor: Mitsuteru Kakino, 14-37, Nishino-cho, Kitakazan, Yamashina-ku, Kyoto, Japan

[73] Assignee: Mitsuteru Kakino, Kyoto, Japan

[21] Appl. No.: 520,815

[22] Filed: Aug. 5, 1983

[30] Foreign Application Priority Data

Jan. 10, 1983 [JP] Japan ..... 58-002588
Feb. 23, 1983 [JP] Japan ..... 58-029726

[51] Int. Cl.[4] ..... H01J 29/50; H01J 31/00

[52] U.S. Cl. ..... 313/495; 313/409; 313/422; 313/446

[58] Field of Search ..... 313/409, 413, 415, 422, 313/446, 447, 495, 496, 497

[56] References Cited

U.S. PATENT DOCUMENTS 3,935,499 1/1976 Oess ..... 313/495

*Primary Examiner*—David K. Moore

*Assistant Examiner*—K. Wieder

*Attorney, Agent, or Firm*—Brumbaugh, Graves, Donohue & Raymond

[57] ABSTRACT

There is provided a flat cathode ray tube, wherein a plurality of individual thermionic emission cathodes symmetrically arranged at a predetermined equal spacing on a plane parallel to an image display plate, the same plurality of grids, and fluorescent anode portions which emit light by irradiation with the electrons incident therein, are inserted and sealed in a high vacuum envelope whose image display plate is transparent. For use in a color television system, the cathode ray tube further includes a system for deflecting the individual beams to appropriate color spots in the anode. There is further provided a method for manufacturing a thin television picture tube using photolithographic techniques which make possible a tube which is between 1 and 30 millimeters in thickness with the picture area of a conventional tube.

6 Claims, 8 Drawing Figures

FLAT CATHODE RAY TUBE

BACKGROUND OF THE INVENTION

The present invention relates to a television picture tube and a manufacturing method thereof, and more particularly to a television picture tube whose thickness is between 1 mm and 30 mm and of which the picture area may be as large as that of a conventional picture tube.

It is no less than 30 years since several attempts have been made and proposed in various countries of the world for flat or planar black-and-white television and color television, which has not yet been put into a practical use. For the planar display device other than a cathode ray tube (CRT), not less than 10 kinds have been developed such as plasma display panel (PDP), light emitting diode (LED), electron chrome display (ECD), liquid crystals, etc. In case of the liquid crystals, however, there is a disadvantage that this method is limited to black-and-white and in case of a PDP having capacity of full color, its brightness is generally only 1% of that of a CRT causing dark images. Further, with a CRT, it is not feasible to make it thin because of the mechanical limitations incidental to the need for an electron gun, grid, deflecting coil, etc.

SUMMARY OF THE INVENTION

It is, therefore, an object of the present invention to provide a thin or flat television picture tube having a thickness between 1 mm and 30 mm, based on CRT general principles, but wherein the electrons emitted are not required to be deflected for scanning in either the horizontal or vertical direction, so that the beams may be very short without negatively affecting the performance thereof, and thereby eliminating the disadvantages of the prior art CRT.

It is a further object of the present invention to provide a flat television picture tube by manufacturing each element by means of a photolithography process technology so as to increase the accuracy in the arrangement of each element, thereby improving the quality of picture.

In accordance with the present invention, the operating principle of the picture tube remains unchanged from a conventional CRT, and accordingly it is sufficient merely to describe the structural novelty of the present invention.

Notwithstanding, the present invention is characterized and featured by numerous cathodes, for example, 367,500 unitary cathodes to provide the picture elements needed for 525 lines in the vertical direction and 700 elements in the horizontal direction. These cathodes are arranged or formed in the desired array on a base plate by a photolithographic process, such as photoetching, and the grids for the focusing control of the emitted thermionic beams are also arranged or formed in the desired array on a perforated base plate provided in parallel at a predetermined spacing. Additionally, the individual electron beams are not substantially deflected but left to progress in a straight line toward fluorescent anodes. In case of black-and-white television, input signals from a transmitter are applied in turn to individual cathodes or grids of the picture tube, successive elements of each horizontal line in turn, and then successive lines in turn, and for an instant a selected one of the thermionic beams irradiates the corresponding anode portion, producing a luminous flux so that a whole image may be formed. The number of cathodes is not limited to the above-described value; however, the less the number thereof, the coarser or decreased definition of the image in relation to the transmitting system.

The base plate for the cathodes and the base plate for the grids are made of an electrical insulating material whose thickness is minimized, and the spacing between the two base plates may be small so that the thickness as a whole may be between 1 mm and 30 mm.

Each of the cathodes, grids and output fluorescent anodes is enclosed in a high vacuum glass bulb, and the output face plate is formed of a transparent glass member in the same manner as in the prior art.

Thus, in accordance with the present invention, a television picture tube comprises a plurality of thermionic emission cathodes symmetrically arranged with a predetermined equal spacing therebetween arranged in a plane which is parallel to a plate which supports fluorescent anodes which emit light by irradiation. A separate control grid is interposed between each cathode and its anode. All these are sealed in a high vacuum tube which has image display face plate which is transparent.

Although the present invention is useful for either black-and-whilte television or color television, in case of the latter it is further required that the following functions be added. Namely, the beams emitted from the cathodes and controlled by the grids to be formed into electron beams are required to have a deflecting system sufficient that appropriate deflection may be made for the selected emission in turn of red, blue and green lights from the fluorescent material of the anodes. A maximum deflecting angle of about 20° is sufficient in the available fluorescent screen systems used in color television picture tubes. The required deflecting systems can be formed in an integrated unit of either the horizontal type or the vertical type or may comprise individual deflecting systems corresponding to the number of individual cathodes. The deflecting angle in such a system is required to be an electron beam diffusing angle wherein the diffusion or scattering of the electron beams does not interfere with the light spot of the selected ones of the three colors.

Thus, for color television, there is provided a television picture tube, comprising a plurality of thermionic emission cathodes symmetrically arrayed with the predetermined equal spacing therebetween in a plane parallel to an image display plate or face plate, the same plurality of grids and deflection systems by which each controlled electron beam emitted past it is deflected to one of three positions within an angular scope sufficiently small not to interfere with any adjacent controlled electron beam, and fluorescent anodes which emit red, green and blue lights by irradiation by controlled electron beams. These are all inserted and sealed in a high vacuum tube of which the image display or face plate is transparent.

BRIEF DESCRIPTION OF THE DRAWINGS

In the accompanying drawings, in which like parts are designated by the same reference numerals and characters throughout.

DESCRIPTION OF THE PREFERRED EMBODIMENTS

Figure 1:
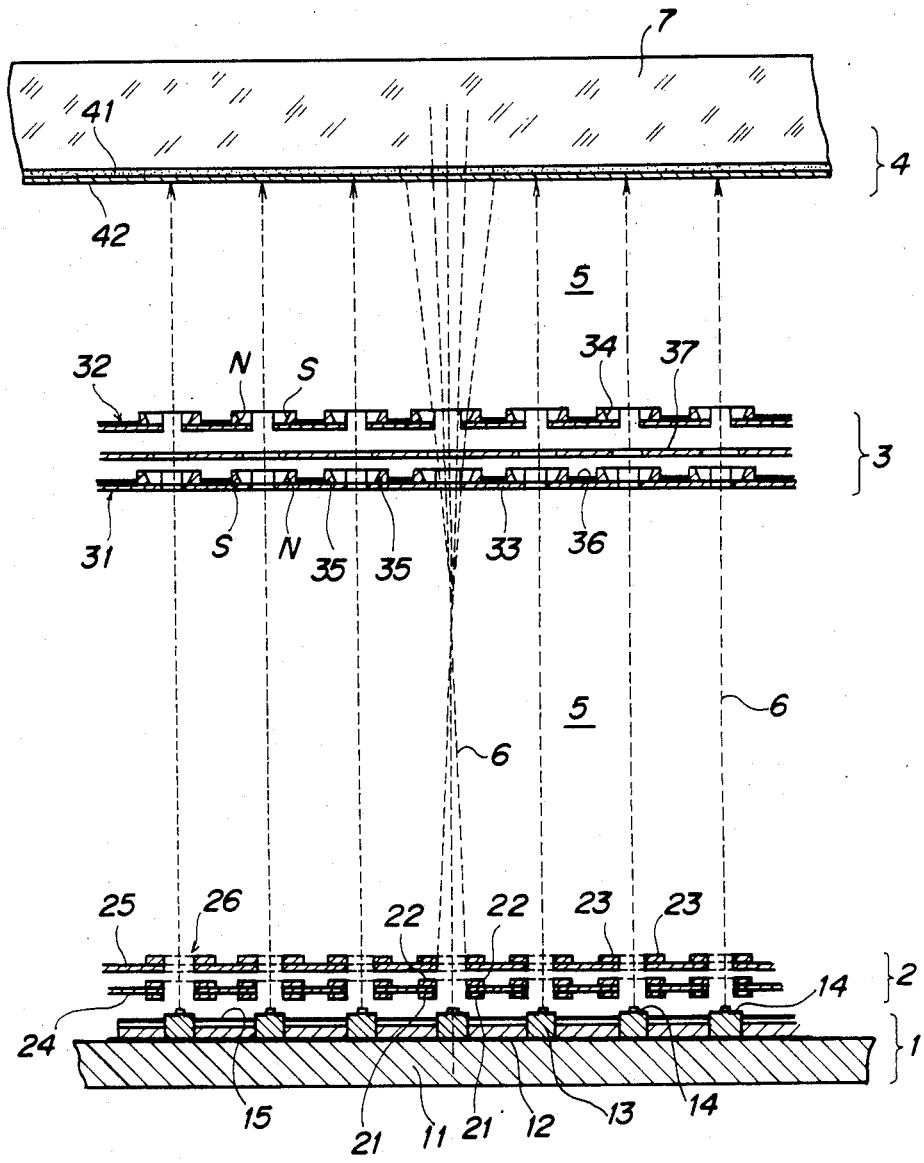
FIG. 1 is an enlarged sectional view illustrating a substantial part of an exemplary television picture tube according to the present invention.
Figure 2:
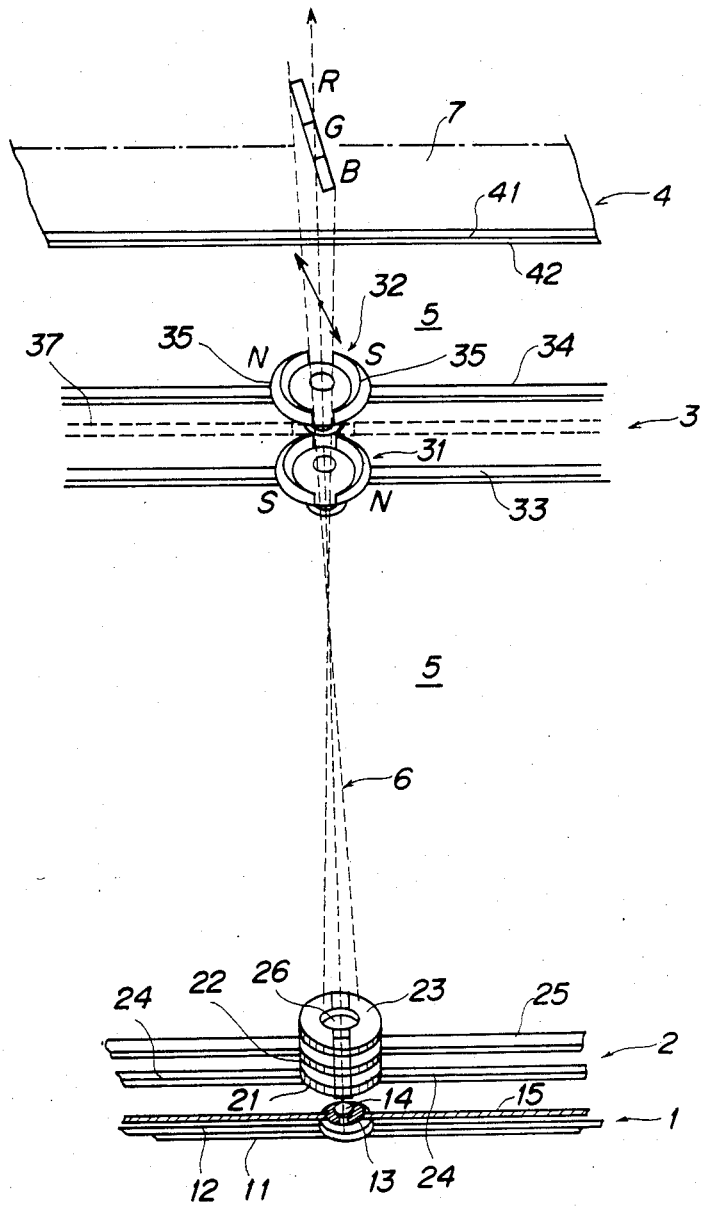
FIG. 2 is a partially perspective view of the television picture tube of FIG. 1.

Referring now to the drawings, FIG. 1 shows an enlarged sectional view illustrating an exemplary television picture tube, and FIG. 2 shows a partially perspective view of each element of the said picture tube.

In the drawings, cathode assembly 1, grid assembly 2, deflecting system 3, anode assembly 4, high vacuum space 5 and thermionic beam 6 emitted from said cathode are shown, respectively. a transparent glass plate 7 is included for protecting the output image, which advantageously is part of the envelope of the tube enclosing the various elements mentioned.

The cathode 1 comprises an electrical insulating base plate 11 made of ceramic or the like, a cathode voltage supply circuit 12 printed on said insulating base plate, a metallic body thermionic emitter 13 formed by a photolithographic process and adjacent to said circuit 12, an annular heating element 14 mounted on the surface of said emitter body 13, and printed wiring 15 to connect said heating element to the supply circuit 12.

Each of these elements is formed by a printing process technology such as photo-etching, so as to be a thin layer of finely detailed pattern and minimum thickness. The temperature created by the heating element 14 is approximately 800° C. and because the heating is so localized involves limited energy; the release or heat generation as a whole is below 100° C., which is sufficiently handled by the convection of the outside air. Further, each element is in a high vacuum so as not to be affected by said heat release.

In the case of a 14 inch picture tube, for example, the base plate 11 would have the same dimension as the image display plate 7 of the picture tube and is arranged in parallel thereto; the total number of cathodes becomes 367,500 when one unit is arranged to correspond to one of the mesh-like crossovers comprising 525 lines in the vertical direction and 700 elements in the horizontal direction. It is easy to form such an array by photolithographic process technology, such as photo-etching or the like. The material of the thermionic emitters remains unchanged from conventional CRT.

Referring to the grid system, the grid assembly 2 comprises a first grid 21, a second grid 22 and a third grid 23; the first grid controls the number of electrons emitted by a cathode by being at a lower electric potential or bias voltage than the cathode. Each of the electron emitters or guns is dependent on the control provided by such control grid in the usual manner of control grids. A computer may be used to control the voltage on the individual control grids.

The grids 22, 23 serve primarily to focus the electrons emitted into a beam of controlled dimensions in known fashion.

The details of the grid assembly 2 is best seen from FIG. 2 which shows an exploded view of one element of the grid array. The various grids typically are formed by patterning a metallic layer deposited by plating, vapor deposition or the like on a heat-resistant insulating base plate. First grid 21 and the second grid 22 advantageously are formed on opposite surfaces of a first base plate 24, and third grid 23 is formed over a second base plate 25. Each annular grid includes a central performation or through hole for passage of the electron beam therethrough. These holes can be formed by known photo-etching techniques. There is one set of three grids for each of the cathodes.

Referring now to the deflecting system 3, either a deflecting coil or deflecting magnet can be used for this system in the manner of a conventional CRT. In the case of a color television picture tube according to the present invention, the deflecting system 3 is employed only for deflecting the electron beam in turn to the desired one of the anode spots for red, blue and green or corresponding to the three primary colors. For this limited function, the deflecting angle is 20° and less, which is less than the angle used for deflecting the electron beam when it is scanned in a typical CRT.

The deflection assembly 3 comprises first deflecting element 31 and second deflecting element 32, each of them having a north pole and south pole. Voltage is applied so that the north pole and south pole of the first deflecting element 31 and those of the second deflecting element 32 are respectively in opposite phase. The deflecting system 3 is formed on heat resistant plastic plates 33, 34 by beams of plating, spettering, vapor deposition or the like, and are shaped by etching.

The desired relation among signal, current and voltage of each part is correlated by a synchronizing circuit in the fashion usual for color television picture tubes.

The intensity of each color spot is dependent on the number of electrons impacting the associated spot of the fluorescent plate, which number is dependent on the cathode current and the action of the control grid. The deflecting system is used to control the number of electrons incident on the individual color spots, and the color is dependent on the relative number striking the three color spots of each picture element. Ten tones of each color are generally feasible. Individual color spots are integrated to form the desired picture image in the usual fashion.

The anode 4 comprises a transparent glass plate 7 which forms a part of the tube envelope, a fluorescent layer 41, an anode electrode 42 and a metal backing layer, if necessary. In these respects, it remains unchanged from conventional CRT.

Figure 3:
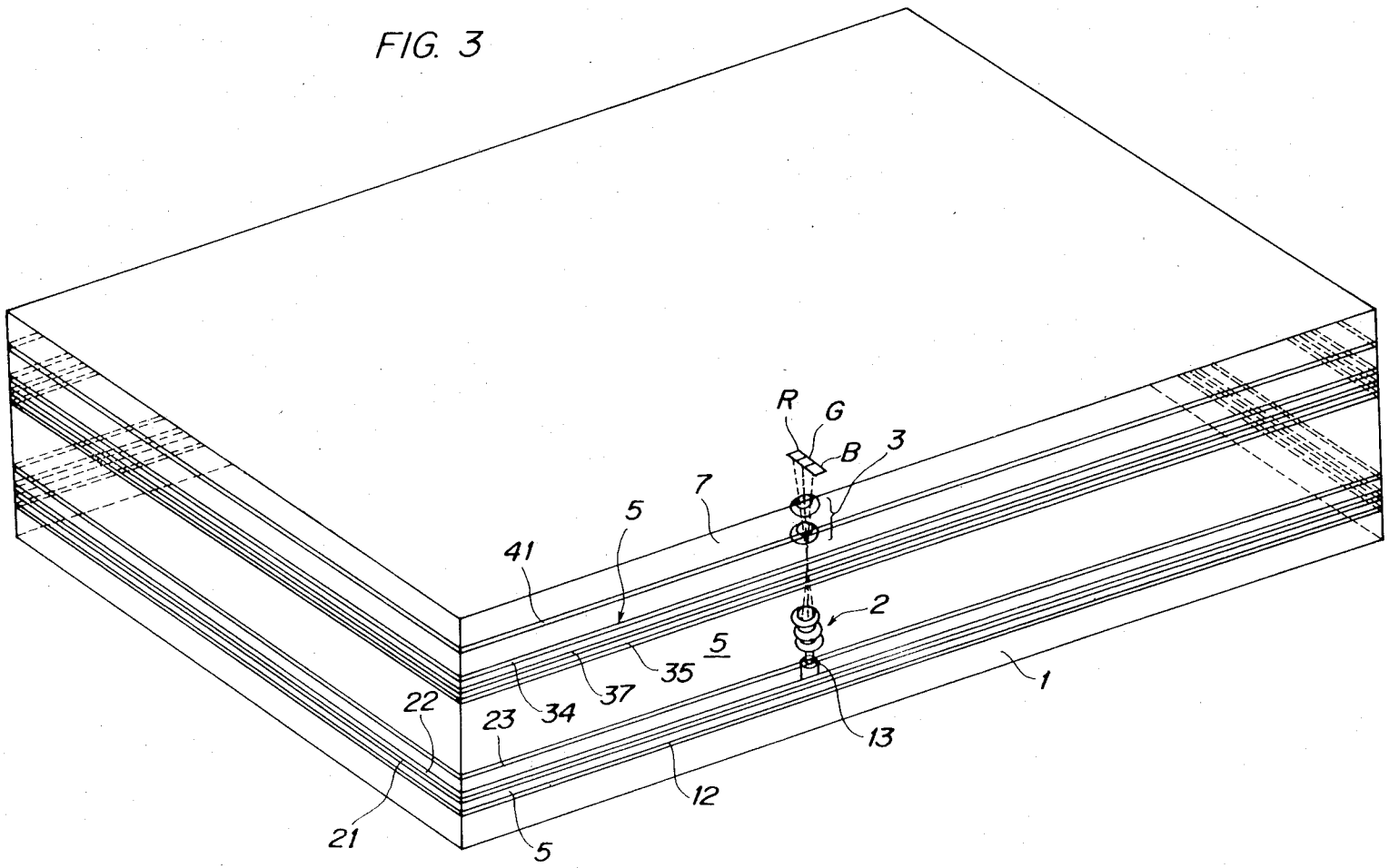
FIG. 3 is an enlarged perspective view of the television picture tube.

A television picture tube according to the present invention having the above-described form, is shown in FIG. 3 in the form of an enlarged perspective view, in which its envelope is omitted except for the output fluorescent plate portion. The numerals and characters are the same as in FIGS. 1 and 2 for like elements.

Because the total thickness of the instant television picture tube is between 1 mm and 30 mm, the size of the face can be so designed to be as small as the size of the face plate of a wristwatch, for example. In such case, the number of cathodes can be descreased with little noticeable picture degradation.

Referring now to the method or process for manufacture of the tube described, photolithographic process technology, such as photo-etching, can be used. More particularly, the various elements can be manufactured by a combination of the following steps:

(a) A step for the manufacture of the thermionic emission cathode and grid of the television picture tube, and also the electron beam deflecting system in case of color television picture tube, which involves forming a metallic layer on a base plate.

(b) A step in which the upper surface of said metallic layer is coated with photo-resist, (c) A step in which a desired pattern is printed on the photo-resist by exposure to light so as to form an etch-resistant film thereon, (d) A process in which said photo-resist is developed to remove the unexposed portion and any portion not protected by said etch resistant film, (e) A process in which portions of the metallic layer not coated with the etch-resistant film are dissolved by an etching solution, and (f) A process in which said etch-resistant film is finally removed.

Figure 4:
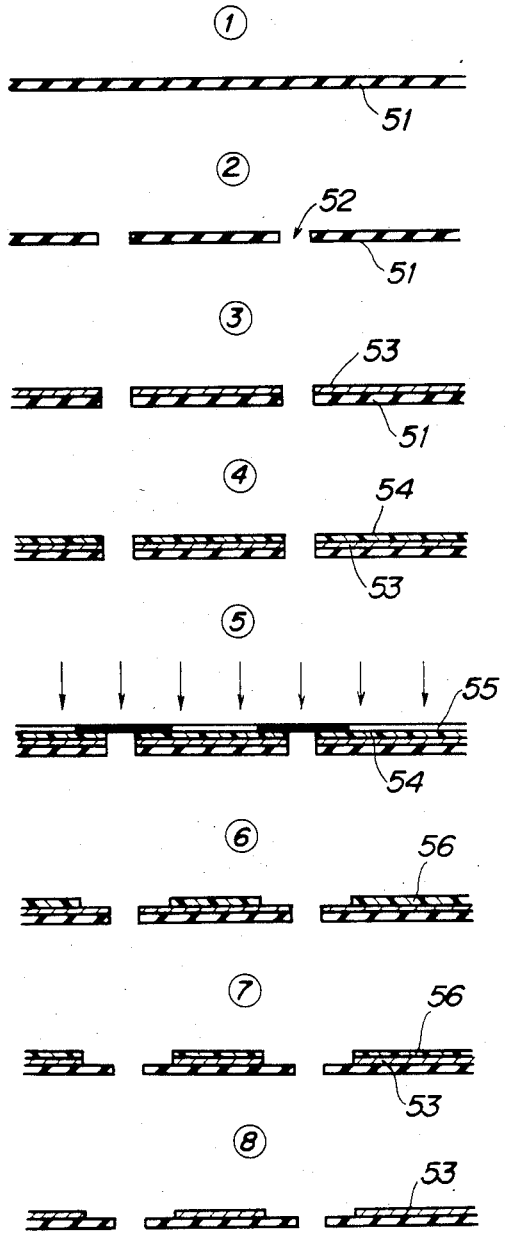
FIG. 4 is a enlarged sectional view useful in describing the fabrication of the grid forming part of the television picture tube.
Figure 4:
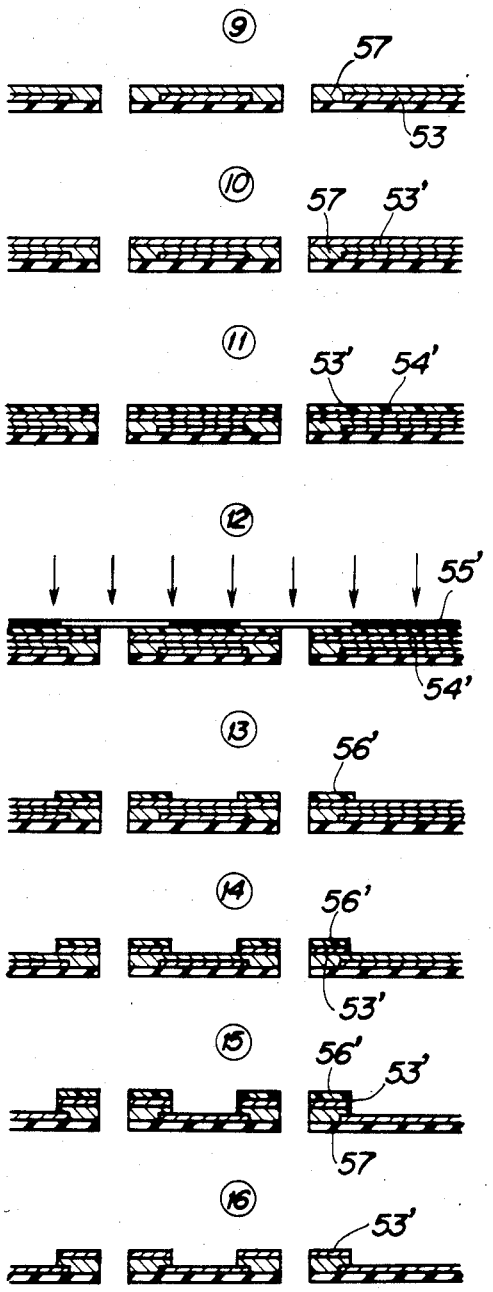

In this respect, FIG. 4 is an enlarged sectional view useful in describing the manufacturing process of the control grid. The principles for manufacturing the thermionic emission cathode and electron beam deflecting system are essentially the same as that for the grid; the description of the manufacturing method that follows refers mainly to the grid as a typical case. The paragraph numerals below correspond to the number of the steps shown in FIG. 4.

(1), (2) An electrical insulating base plate 51 is provided with a through hole 52 for every element. In the case of fabricating the thermionic emission cathode, such a hole forming step is not required.

(3) A layer of copper 53 is formed on one side of the electrical insulating base plate 51.

(4) The upper surface of the layer of copper 53 is coated with a photo-resist 54. As is well known, there are two types of photo-resist, a negative type and a positive type. The negative is illustratively used in the description hereinafter.

(5) A negative plate 55 for printing which had been prepared by means of photo-copying technology is closely adhered to the upper surface of the photo-resist 54, and the pattern of circuit is printed by exposure to appropriate light, thereby forming an etch-resistant film thereon. In the drawing, each of the arrows indicates a light beam.

(6) The photo-resist 54 is developed so that an unexposed portion, on which there is not formed the etch-resistant film 56, may be removed (in case of positive photo-resist, the exposed portion is removed). The developer must be chosen to be compatible with the photo-resist chosen. One example is the combination of Shipley's AZ-111 as the photo-resist and Shipley's AZ-303 as the developer.

(7) A portion of the layer of copper 53 not coated with the etch resistant film 56 is dissolved by an etching solution comprising, for example, 100 ml of distilled water, 66 ml of hydrochloric acid whose specific gravity is 1.19, and 20 g of ferric chloride.

(8) The etch resistant film 56 is removed to expose said layer of copper 53. Referring to the solution used for removal, an appropriate choice is required, for example, in case AZ-111 is used for photo-resist, acetone is suitable.

(9) A layer 57 of a conductive metal other than copper, such as nickel, is formed on the upper surface of the layer of copper 53 by any suitable means, such as plating or coating, vapor deposition, sputtering or the like.

(10) Another layer of copper 53' is further formed on the upper surface of said layer of nickel 57 by plating or the like.

(11) The upper surface of the layer of copper 53' is coated with another photo-resist 54'.

(12) Another negative printing plate 55' is positioned closely to the upper surface of the photo-resist 54', and the patterns of elements are printed by exposure, thereby forming a etch-resistant film thereon.

(13) The photo-resist 54' is developed so that unexposed portion not forming the etch-resistant film 56' may be removed.

(14) The portion of the layer of copper 53' not coated with the etch-resistant film 56' is dissolved by an appropriate etching solution, such as that used in step (7).

(15) The portion of the layer of nickel 57 not coated with the etch-resistant film 56', is dissolved by a etching solution comprising, for example, 506 ml of distilled water, and 506 ml of nitric acid whose specific gravity is 1.40.

Other etching solutions will be useful with other metals. Other metals might comprise tungsten, iron, chromium and titanium, for example.

(16) The etch-resistant film 56' is removed to expose the layer of copper 53'.

Figure 5:
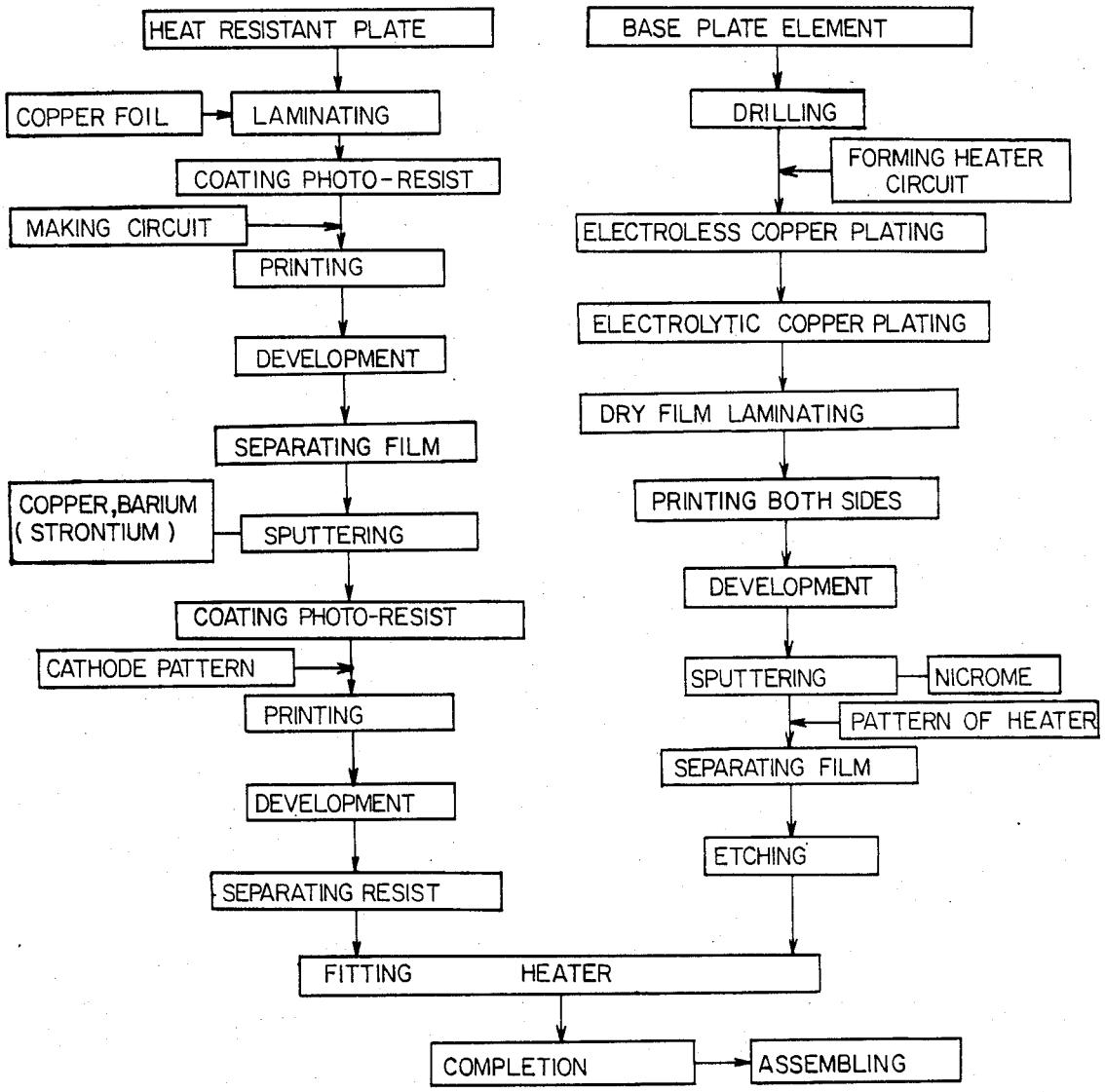
FIGS. 5 through 7 are flow charts showing examples of the manufacturing process of the thermionic emission cathode, the grid and the electron beam deflecting system of the television picture tube, respectively.
Figure 6:
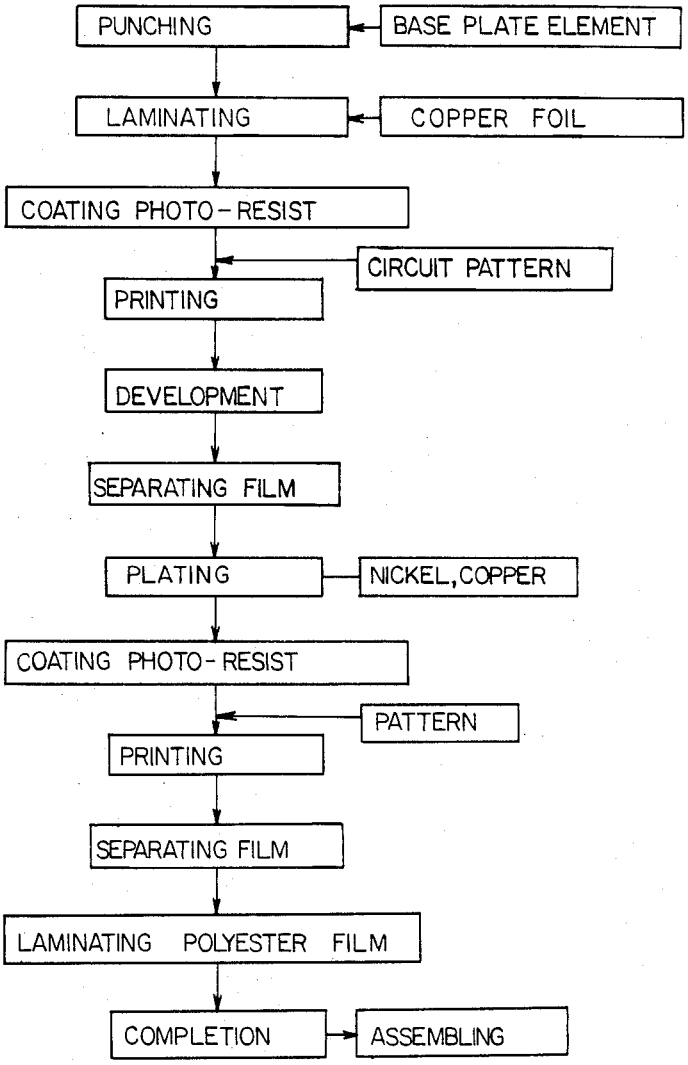
Figure 7:
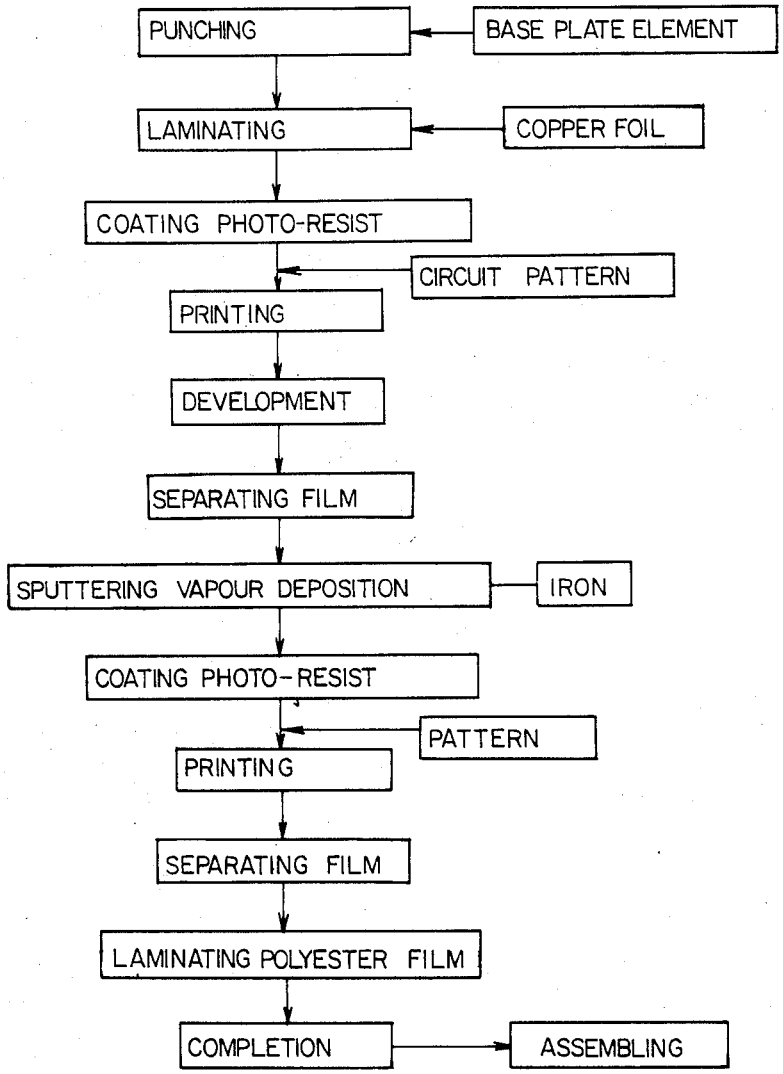

In this connection, FIGS. 5, 6 and 7 are flow charts showing an example of a manufacturing method for a thermionic emission cathode, grid and electron beam deflecting system, respectively.

In conventional television picture tubes, the various pixels of a picture are assigned to their appropriate spot on the face of the picture tube by deflection of an electron beam under control of scanning information in the signal transmitted. In the picture tube of the present invention, scanning is not involved and accordingly the conventional television signal must be converted appropriately if it is to be used in the picture tube of the invention.

Figure 8:
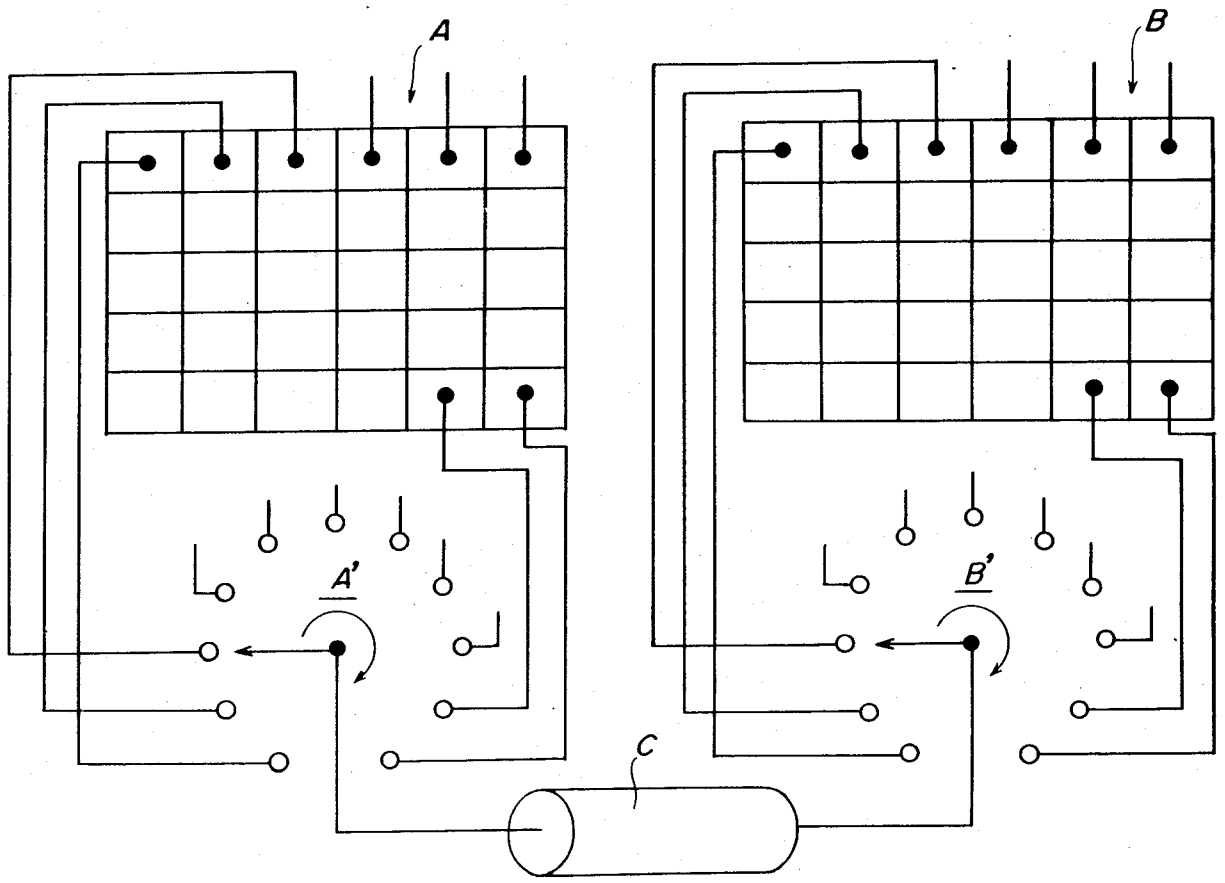
FIG. 8 illustrates schematically that the irradiation of individual picture elements at the cathode ray display at the receiver needs to be synchronized with the pickup of corresponding picture elements at the camera tube at the transmitter.

FIG. 8 is intended to illustrate that at the transmitter, successive signal samples of the picture are generated for transmission by scanning, one line at a time, successive picture elements of one horizontal line, and then successive lines in turn, and that at the receiving end, the signal samples received are applied to the cathodes of the cathode ray tube corresponding to the same position of the camera tube so that successive picture elements are displayed in synchronism with their generation.

It will be evident to those skilled in the art that the present invention is not limited to the details of the foregoing illustrative embodiments, and that the present invention may be embodied in other specific forms without departing from the essential attributes thereof, and it is therefore desired that the foregoing embodiments be considered in all respects as illustrative and not restrictive. Reference is made to the appended claims, rather than to the foregoing description, and all changes which come with the meaning and range of equivalency of the claims are intended to be embraced therein.

I claim:

1. A flat cathode ray tube comprising:

a plurality of cathodes arranged in a two dimensional array, formed as individual elements by patterning a uniform layer of thermionic emissive material which overlies a first planar insulating substrate, and means for energizing each of said cathodes be energized individually in turn in the horizontal and vertical pattern corresponding to the scanning of a picture for television;

a second planar insulating substrate parallel to and spaced from the first insulating substrate, adjacent to the plurality of cathodes, and including a like plurality of individual apertures aligned with individual ones of the plurality of cathodes;

a like plurality of control grids surrounding individual ones of the plurality of apertures for alignment with the plurality of cathodes and having been formed by patterning a layer of conductive material overlying the second insulating substrate;

an anode comprising an anode plate electrode coated with fluorescent material and aligned for irradiation by electrons from the plurality of cathodes passing through the apertures in the second insulating-substrate; and an enclosure for enclosing the cathodes, grids and anode in a high vacuum.

2. A flat cathode ray tube in accordance with claim 1 which further includes a third planar insulating substrate parallel to and spaced from he second insulating substrate between it and the anode and including a like plurality of apertures aligned with the apertures in the second insulating layer to permit passage therethrough of electrons passing through the grids;

and deflecting means surrounding each of the apertures in the third insulating substrate and having been formed by patterning a uniform layer of material overlying the third insulating substrate for deflecting electrons passing through the apertures in the third insulating substrate within a range to avoid overlap with electrons passing through an adjacent aperture; and in which said anode coating of fluorescent material includes for each aperture in the third insulating layer three regions characteristic of three different colors and the deflecting means surrounding the apertures in the third insulating layer deflects the electrons to selected one of the regions.

3. A cathode ray tube in accordance with claim 1 in which the thickness of the tube is between one and thirty millimeters.

4. A cathode ray tube in accordance with claim 2 in which the thickness of the tube is between one and thirty millimeters.

5. A cathode ray tube in accordance with claim 3 in which the tube includes at least several hundred thousand cathodes.

6. A cathode ray tube in accordance with claim 4 in which the tube includes at least several hundred thousand cathodes.

* * * * *